US007980489B2

(12) United States Patent
Righini

(10) Patent No.: US 7,980,489 B2
(45) Date of Patent: Jul. 19, 2011

(54) MULTIPLE CONFIGURATION SHOWER DEVICE

(75) Inventor: Giuseppe Righini, Imola (IT)

(73) Assignee: Packcenter S.R.L., Imola (IT)

( * ) Notice: Subject to any disclaimer, the term of this patent is extended or adjusted under 35 U.S.C. 154(b) by 126 days.

(21) Appl. No.: 12/293,641

(22) PCT Filed: Mar. 27, 2007

(86) PCT No.: PCT/IB2007/000818

§ 371 (c)(1),
(2), (4) Date: Apr. 14, 2009

(87) PCT Pub. No.: WO2007/116274

PCT Pub. Date: Oct. 18, 2007

(65) Prior Publication Data

US 2010/0032500 A1 Feb. 11, 2010

(30) Foreign Application Priority Data

Mar. 30, 2006 (IT) ..... BO2006A0219
Mar. 30, 2006 (IT) ..... BO2006A0220

(51) Int. Cl.

| | |
|---|---|
| ***B05B 1/16*** | (2006.01) |
| ***B05B 1/18*** | (2006.01) |
| ***B05B 1/14*** | (2006.01) |
| ***B05B 1/12*** | (2006.01) |

(52) U.S. Cl. ..... 239/393; 239/392; 239/394; 239/436; 239/525; 239/561

(58) Field of Classification Search ..... 239/310, 239/312, 390–395, 436, 443, 444, 447–449, 239/525, 548, 556, 560, 561, 566
See application file for complete search history.

(56) References Cited

U.S. PATENT DOCUMENTS

| | | | | |
|---|---|---|---|---|
| 141,620 | A * | 8/1873 | Barton, Jr. | 239/393 |
| 5,199,639 | A | 4/1993 | Kobayashi et al. | |
| 5,540,386 | A * | 7/1996 | Roman | 239/394 |
| 6,442,775 | B1 | 9/2002 | Gransow et al. | |
| 6,612,507 | B1 * | 9/2003 | Meyer et al. | 239/394 |
| 2005/0045744 | A1 | 3/2005 | Wang | |
| 2006/0059616 | A1 | 3/2006 | Grohe | |

FOREIGN PATENT DOCUMENTS

| | | | |
|---|---|---|---|
| EP | 0499151 | A3 | 10/1992 |
| EP | 0654304 | A1 | 5/1995 |
| EP | 1234615 | A2 | 8/2002 |
| JP | 54-112610 | | 1/1978 |
| WO | 8404059 | | 10/1984 |

* cited by examiner

*Primary Examiner* — Darren W Gorman
(74) *Attorney, Agent, or Firm* — Tutunjian & Bitetto, P.C.

(57) ABSTRACT

A multiple configuration shower device includes at least one handle (2) connected to a flexible duct for supplying water and at least one water dispensing element (5). The dispensing element (5) is provided with a plurality of water ejection faces (5*a*, 5*b*, 5*c*, 5*d*), each provided with respective nozzles (U), and comprising at least one connector (6), provided between the handle (2) and the dispensing element (5), which is adapted to allow the manual rotation of the dispensing element (5) about at least one axis which is substantially perpendicular to the handle (2), so as to arrange selectively at least one of the ejection faces (5*a*, 5*b*, 5*c*, 5*d*) substantially in the direction of the user.

16 Claims, 9 Drawing Sheets

Fig. 13
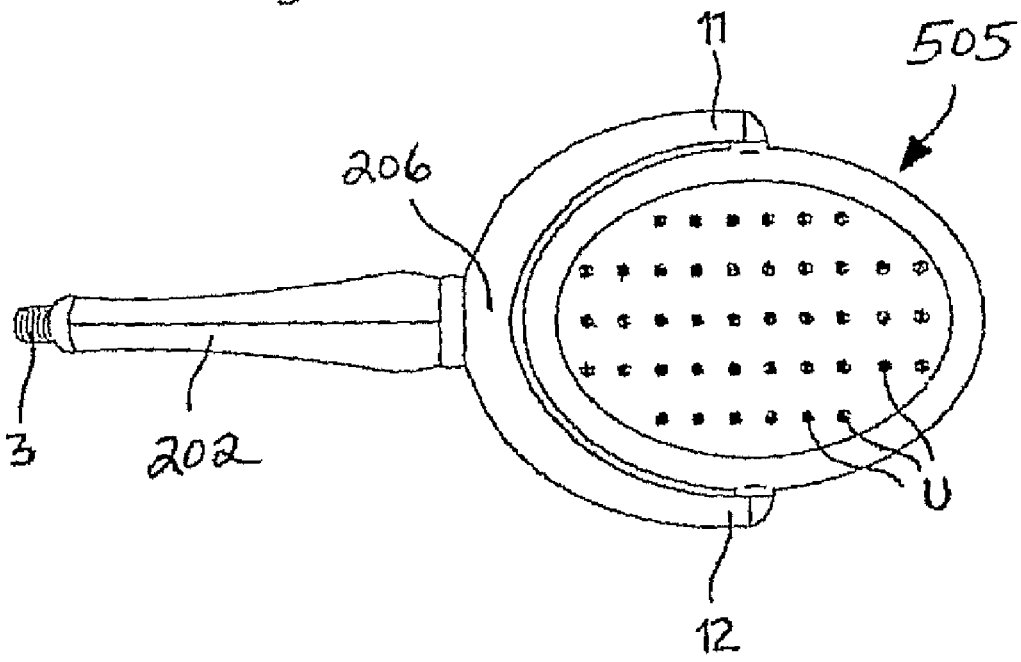
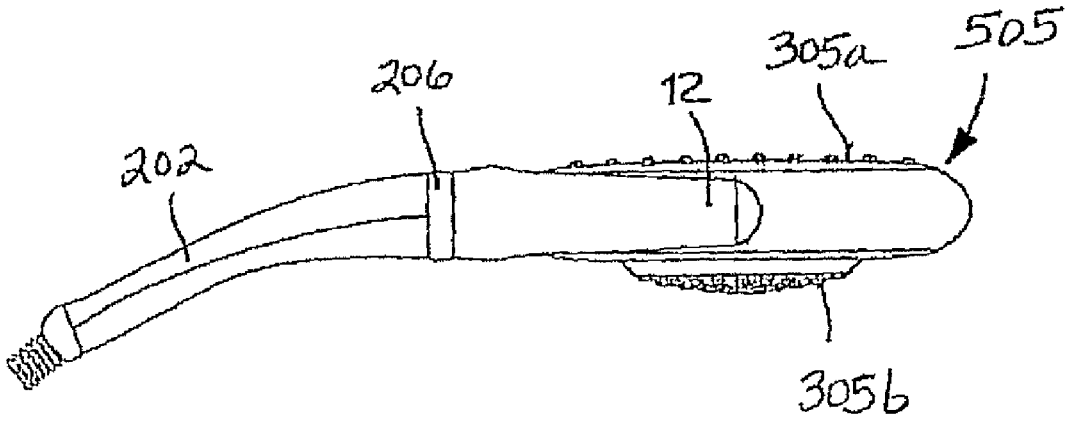
Fig. 14

MULTIPLE CONFIGURATION SHOWER DEVICE

TECHNICAL FIELD

The present invention relates to a multiple configuration shower device.

BACKGROUND ART

As is known, modern shower devices, such as heads connected to a flexible duct for supplying water and spray heads fitted on one of the internal walls of shower enclosures, can adjust the intensity of the jet of water in relation to the specific requirements of the user.

Typically, these devices comprise different sets of dispensing nozzles, toward which the flow of water is diverted selectively (in heads, by means of selection levers), said nozzles having different geometric characteristics and thus providing water jets of different intensity.

However, these adjustments are generally of a rather limited extent and often are rather awkward to perform while one is taking a shower, and in particular for devices of the head type the selection lever is small and difficult to actuate.

Further, modern shower devices are often provided, on the water dispensing surfaces, with massaging elements such as balls, peduncles and/or the like, to be used directly in contact with the skin of the user. The traditional shape of current shower devices utilizes said massaging elements in an extremely limited and in any case awkward manner.

SUMMARY

The aim of the present invention is to obviate the above mentioned drawbacks, by providing a multiple configuration shower device with easier use, i.e., which allows the user to use comfortably a plurality of water jets of different intensities. Within this aim, an object of the present invention is to provide a multiple configuration shower device which is practical and easy to use, in other words, which allows to pass from one configuration to another with a simple and quick gesture.

Another object of the present invention is to provide a multiple configuration shower device which utilizes in the best possible way small massaging elements such as peduncles and balls provided on its water dispensing surface.

Another object of the present invention is to provide a device which has a simple structure, is relatively easy to provide in practice, safe in use, effective in operation, and has a relatively low cost.

This aim and these and other objects, which will become better apparent hereinafter, are achieved by the present multiple configuration shower device, comprising at least one handle which is connected to a flexible duct for supplying water and at least one water dispensing element, characterized in that said dispensing element is provided with a plurality of water ejection faces, each provided with respective nozzles, and in that it comprises at least one connector, provided between said handle and said dispensing element, which is adapted to allow the manual rotation of said dispensing element about at least one axis which is substantially perpendicular to said handle, so as to arrange selectively at least one of said ejection faces substantially in the direction of the user.

BRIEF DESCRIPTION OF THE DRAWINGS

Further characteristics and advantages of the invention will become better apparent from the following detailed description of preferred but not exclusive embodiments of a multiple configuration shower device according to the invention, illustrated by way of non-limiting example in the accompanying drawings, wherein:

FIG. 13 is a plan view of the shower device of FIG. 12;

FIG. 14 is a side elevation view of the shower device of FIG. 12;

DETAILED DESCRIPTION

In the exemplary embodiments that follow, individual characteristics, given in relation to specific examples, may actually be interchanged with other different characteristics that exist in other exemplary embodiments. Moreover, it is noted that anything found to be already known during the patenting process is understood not to be claimed and to be the subject of a disclaimer.

Figure 1:
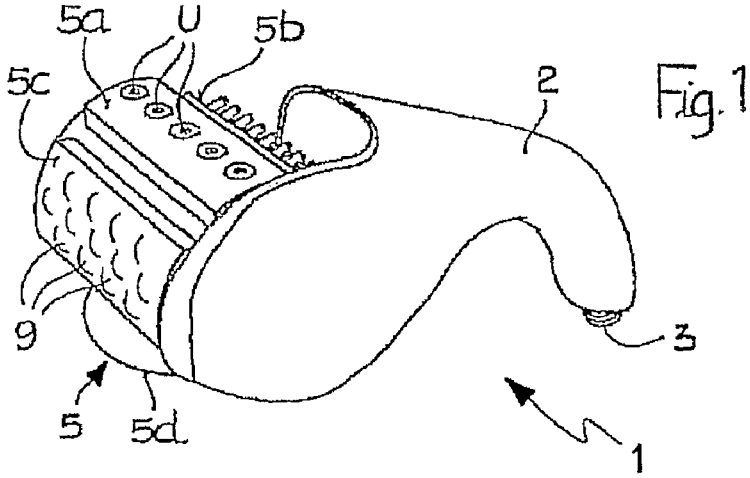
FIG. 1 is a view of a multiple configuration shower device according to the invention, of the shower head type, in a first embodiment.

With reference to FIG. 1, the reference numeral 1 generally designates a multiple configuration shower device according to the invention, of the shower head type, in a first embodiment. The shower device of the head type is absolutely versatile in use and adapted for any type of shower enclosure without any limitation, and is associated with any type of flexible water supply duct. In particular, FIGS. 1 to 14 illustrate exemplary embodiments of a shower device of the head type which is associated with any type of flexible water supply duct, and FIGS. 15 to 21 illustrate exemplary embodiments of the shower device of the wall-mounted shower head type which is mounted on one of the internal walls of the shower enclosure.

As shown in FIG. 1, the shower device of the head type comprises, in a traditional manner, at least one handle, designated by the reference numeral 2, which has at its end a threaded shank 3 for fixing to a flexible water supply duct: the handle 2, conveniently curved so as to assume an ergonomic shape, forms internally at least one water supply channel, which is not shown in the figures for the sake of simplicity but is of a substantially traditional type.

According to the invention, the handle forms a surface 4 for mating with a dispensing element 5, said surface being arranged on a plane which is substantially perpendicular to the water supply channel. The water dispensing element 5 is provided advantageously with a plurality of water ejection faces 5*a*, 5*b*, 5*c*, 5*d*, each provided with respective nozzles U, in any number, shape and distribution; the device of the head type further comprises advantageously at least one connector, generally designated by the reference numeral 6, which is provided between the handle 2 and the dispensing element 5 and is adapted to allow the manual rotation of the dispensing element 5 about an axis which is perpendicular to the water supply channel, so as to arrange selectively at least one of the ejection faces 5*a*, 5*b*, 5*c*, 5*d* substantially towards the user, so as to spray him.

Figure 2:
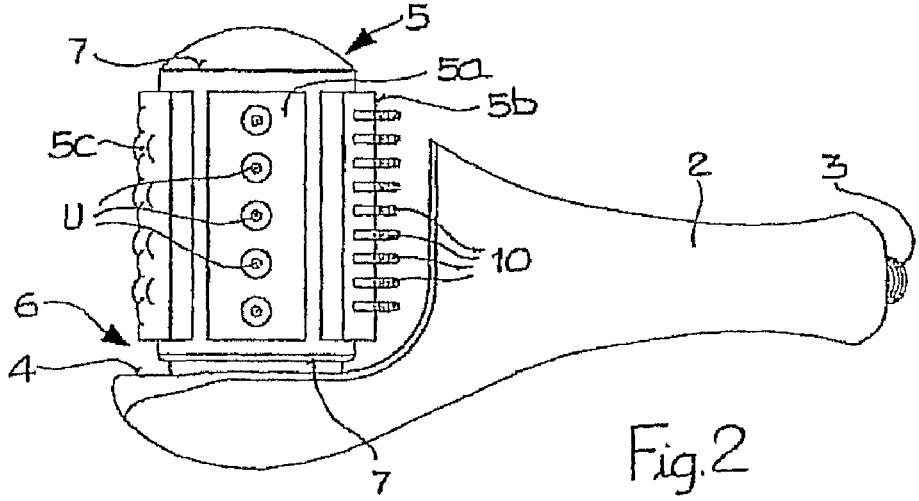
FIG. 2 is a plan view of the shower device of FIG. 1.
Figure 3:
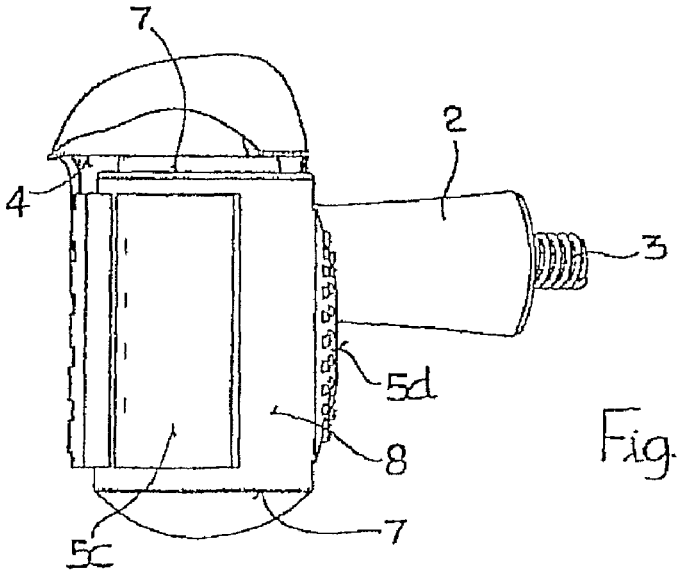
FIG. 3 is a front view of the shower device of FIG. 1.

The dispensing element 5 is substantially cylindrical and substantially coaxial to the connector 6 at a base 7 and has, along the lateral surface 8, a plurality (in the specific case four) of ejection faces 5*a*, 5*b*, 5*c*, 5*d*, which are mutually substantially angularly equidistant (see also FIGS. 2, 3). However, the number of ejection faces can be any in relation to the specific requirements of application.

Figure 1A:
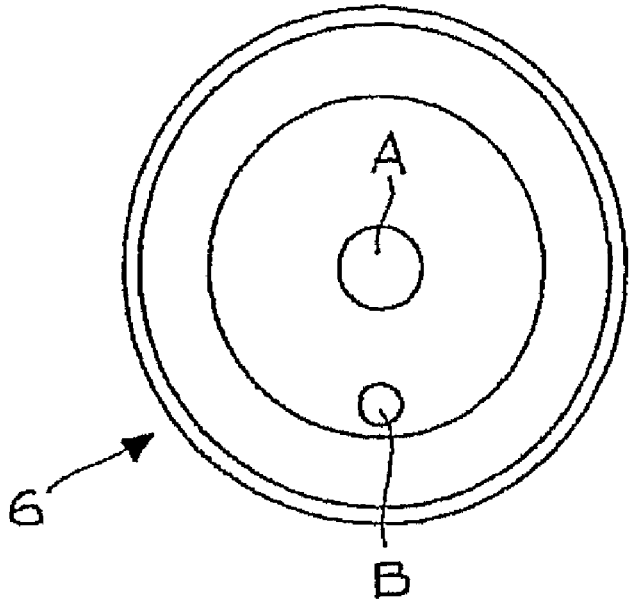
FIGS. 1*a*, 1*b* are detail views of the connection between the handle and the water dispensing element.
Figure 1B:
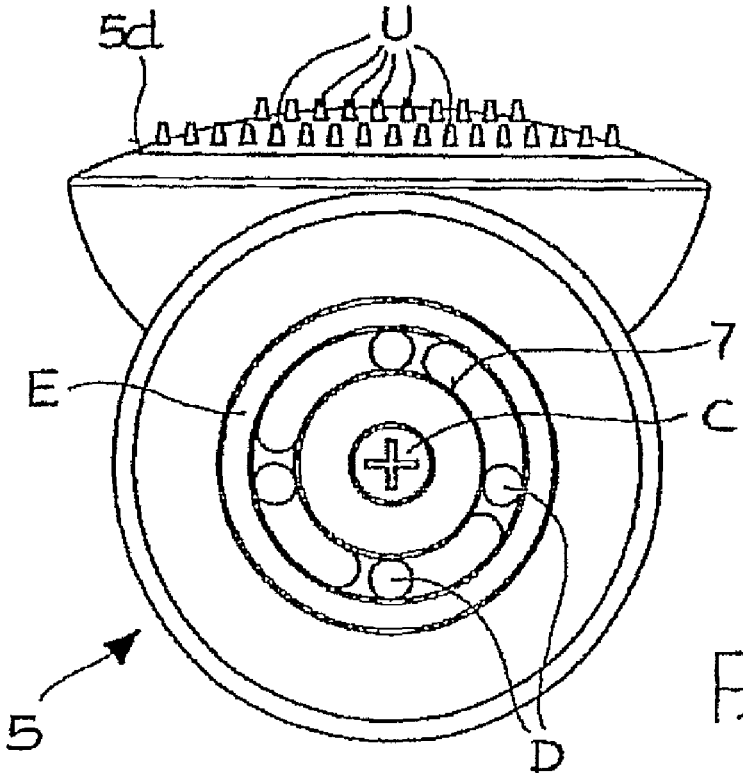

FIG. 1*a* is a detail front view of the connector 6 and more particularly of the surface 4 for mating with the dispensing element 5; the surface 4 forms conveniently a central hole A for mechanical mating and a water outflow port B, which is arranged eccentrically. FIG. 1*b* is instead a front view of the other portion of the connector 6, more particularly of the end of the dispensing element 5. Said end of the dispensing element 5 comprises at least one central pivot C, adapted to engage within the central hole A, and further has a distribution of openings D for the inflow of water (four in the example shown), each connected respectively to the ejection faces 5*a*, 5*b*, 5*c*, 5*d*.

The openings D are arranged substantially along a circumference which is concentric with respect to the pivot C and are mutually angularly equidistant. A flat gasket E with four circumferential slots F is fitted around them. Other sealing gaskets are of course provided where necessary. Advantageously, on the ejection faces 5*a*, 5*b*, 5*c*, 5*d* there are 30 massaging elements such as balls 9, peduncles 10 and/or the like, the action of which is rendered particularly effective by the innovative, i.e., substantially perpendicular, arrangement of the dispensing element 5 with respect to the water supply channel. This arrangement allows to provide more effective pressure with the ejection faces 5*a*, 5*b*, 5*c*, 5*d* with respect to what occurs with shower heads having a traditional shape.

The method of use of the multiple configuration shower head according to the invention is fully intuitive. It is sufficient to produce a manual rotation of the dispensing element 5 in one direction or the other to obtain different water jets in relation to the different characteristics of each of the ejection faces. In particular, by turning the dispensing element 5 about the central pivot C, the port B is connected selectively to one or the other of the openings D, so as to convey water to one or the other of the ejection faces 5*a*, 5*b*, 5*c*, 5*d*. An optimum seal is ensured by the flat gasket E.

Further, the device of the head type can be used very conveniently directly on the body of the user, by applying a massaging pressure with the balls 9 and the peduncles 10, such pressure being particularly effective by way of the arrangement of the rotation axis of the dispensing element 5.

All the components can be made for example of metallic material, or equally of plastic material or any other suitable material.

Each of the ejection faces 5*a*, 5*b*, 5*c*, 5*d* can be provided with at least one receptacle, formed inside the dispensing element 5, which can be accessed by means of a removable cover, on which the nozzles U are provided: said receptacle is designed to contain at least one container of a substantially traditional type or devised for the specific application, which is adapted for the dosage of substances of various kinds for body care, for example salts, soaps, fragrances or others, which are mixed with the stream of water and expelled by the nozzles together with said stream. Moreover, each of the ejection faces 5*a*, 5*b*, 5*c*, 5*d* can be equipped 30 with other body hygiene tools, such as brushes, sponges and/or the like.

It has thus been shown that the invention achieves the intended aim and objects. The invention thus conceived is susceptible of numerous modifications and variations, all of which are within the scope of the appended claims.

Figure 4:
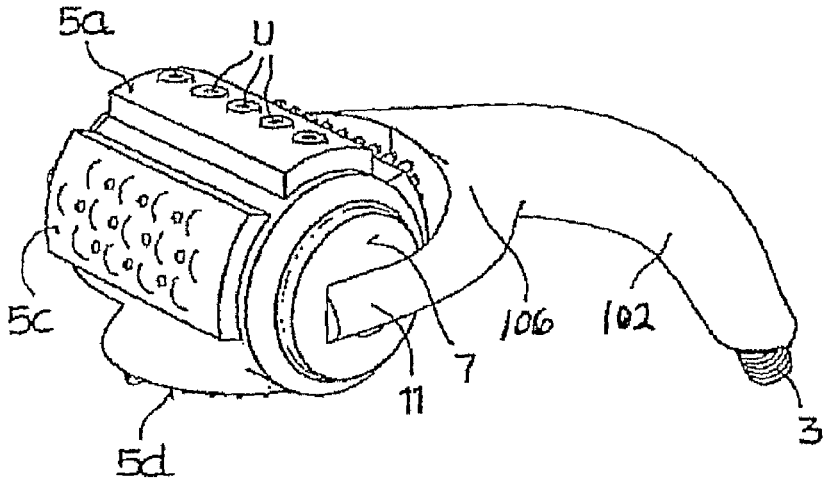
FIG. 4 is a perspective view of the device of the shower head type in a second embodiment.
Figure 5:
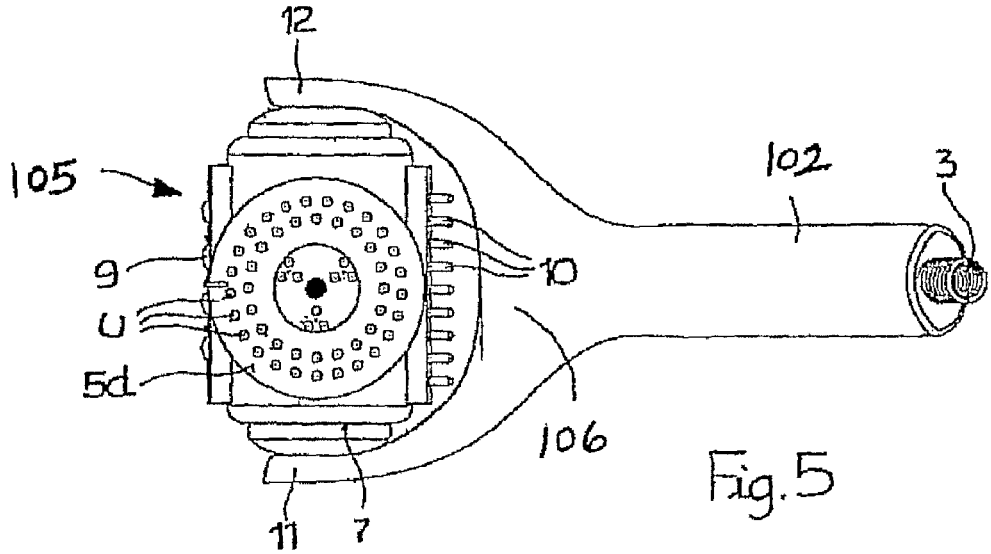
FIG. 5 is a bottom view of the shower device of FIG. 4.
Figure 6:
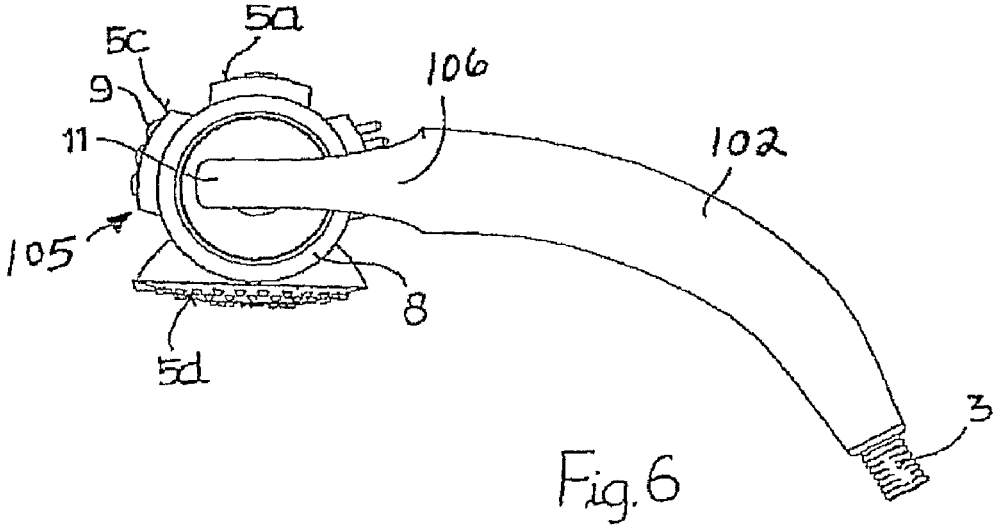
FIG. 6 is a side elevation view of the shower device of FIG. 4.

A second embodiment of the device of the head type for shower according to the invention is shown in FIGS. 4, 5, 6. Here, a connector 106 is substantially fork-shaped and comprises a first end 11 and a second end 12 for hermetic rotary connection (as shown in FIGS. 1*a*, 1*b*) with mutually opposite surfaces of the dispensing element 105, i.e., at the end faces 7. The connector 106 forms internally, not shown for the sake of simplicity, at least one channel for connecting the threaded shank 3 to the first end 11 and to the second end 12, which is also fork-shaped.

The dispensing element 105 of the example of FIGS. 4, 5, 6 is substantially cylindrical, with mutually opposite surfaces for connection to the connector 106 provided at the end faces 7, and is provided, along the lateral surface 8, with a plurality of ejection faces 5*a*, 5*b*, 5*c*, 5*d*, which are substantially mutually angularly equidistant. This solution ensures higher reliability in use of the shower head, especially as regards using a massaging action on the body of the user with the balls 9 and the peduncles 10, which is more stable and precise. Actually, the dispensing element 105 can assume any shape in relation to the specific requirements of use, as shown by the examples described hereinafter.

Figure 7:
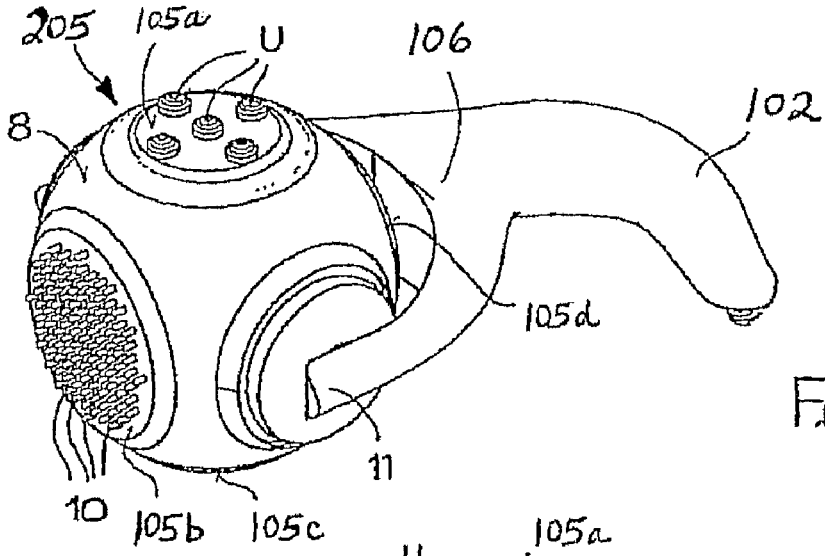
FIG. 7 is a perspective view of the device of the shower head type in a third embodiment.
Figure 8:
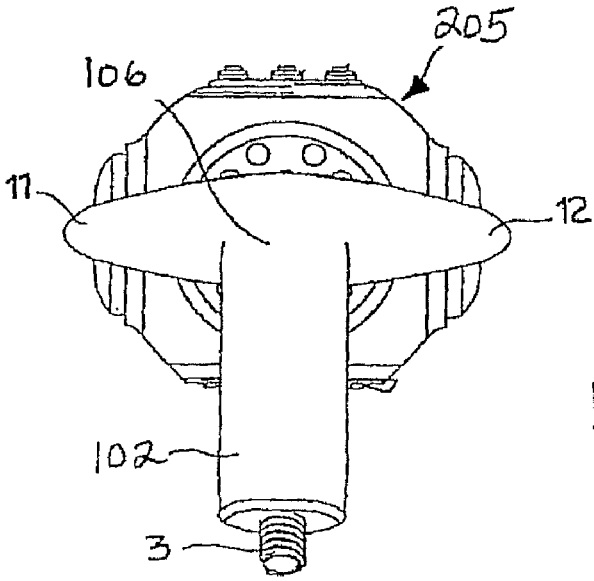
FIG. 8 is a rear view of the device of FIG. 7.

FIGS. 7, 8 are views of a third embodiment of the shower head according to the invention. Here, a dispensing element 205' is substantially spherical and forms an axis of rotation which defines two mutually opposite connecting faces 7: the ejection faces 105*a*, 105*b*, 105*c*, 105*d*, which are mutually substantially angularly equidistant, are provided about the rotation axis on the remaining portion of the surface of the dispensing element 205.

Figure 9:
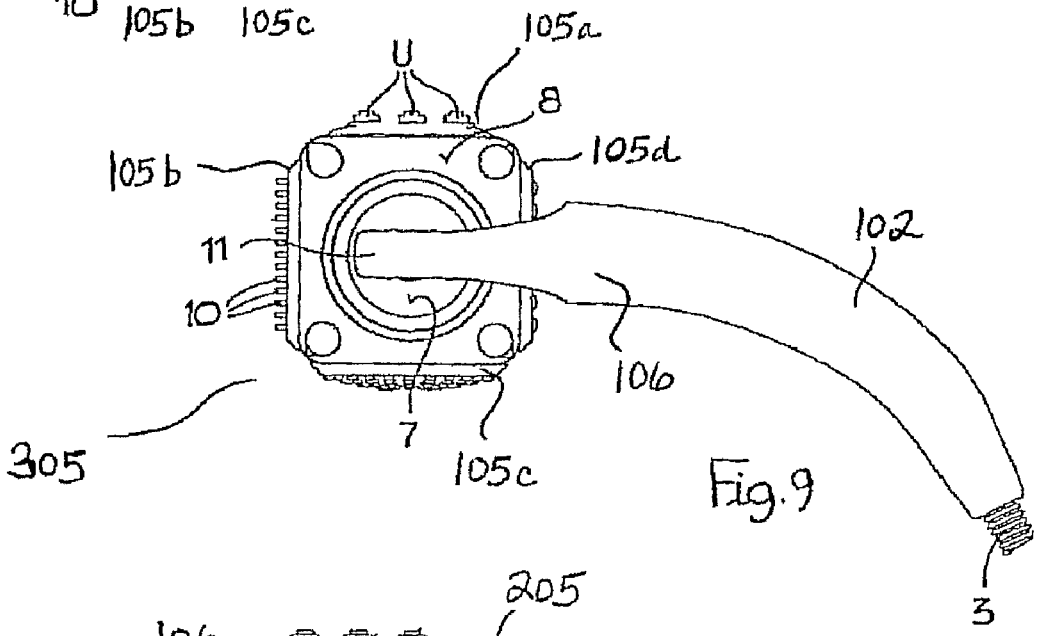
FIG. 9 is a side elevation view of the device of the shower head type in a fourth embodiment.

In a fourth embodiment, shown in FIG. 9, a dispensing element 305 is substantially polyhedral, is connected to the second end 12 of the connector 106 at an end face 7 thereof, and has lateral surfaces which define the water ejection faces 105*a*, 105*b*, 105*c*, 105*d*. In the embodiment shown, the dispensing element 305 has in particular four ejection faces, but their number can be any.

Figure 10:
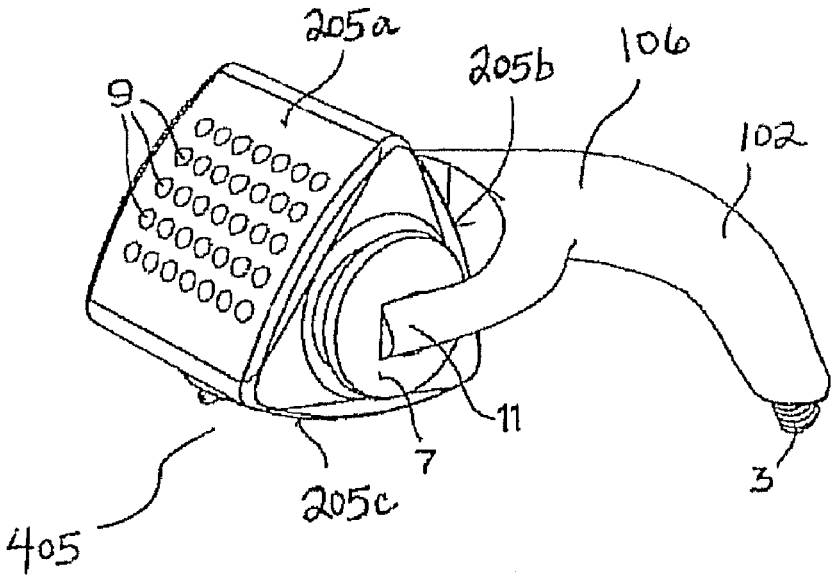
FIG. 10 is a perspective view of the device of the shower head type in a fifth embodiment according to the invention.
Figure 11:
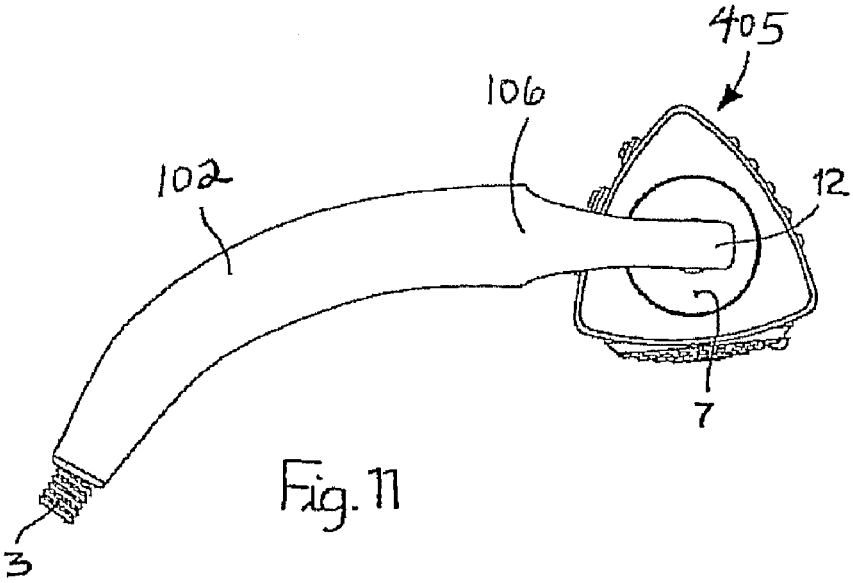
FIG. 11 is a side elevation view of the shower device of FIG. 10.

A fifth embodiment is shown in FIGS. 10 and 11: a dispensing element 405 is conveniently substantially polyhedral, for example with a triangular cross-section, with mutually opposite end faces 7 for connection to the connector 106, and with lateral faces which form the water ejection faces 205*a*, 205*b*, 205*c*.

Figure 12:
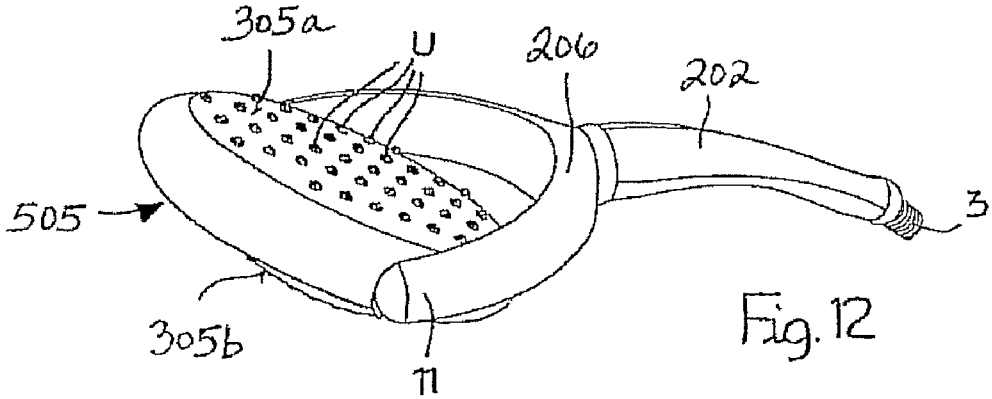
FIG. 12 is a perspective view of the device of the shower head type in a sixth embodiment.

A sixth embodiment is shown in FIGS. 12, 13, 14. The dispensing element 505 has a substantially flat lens-like shape, which is advantageous because it has a larger area, with two mutually opposite water ejection faces 305*a*, 305*b*; the connector 206 is connected to the dispensing element 505 at two diametrically mutually opposite points.

Figure 15:
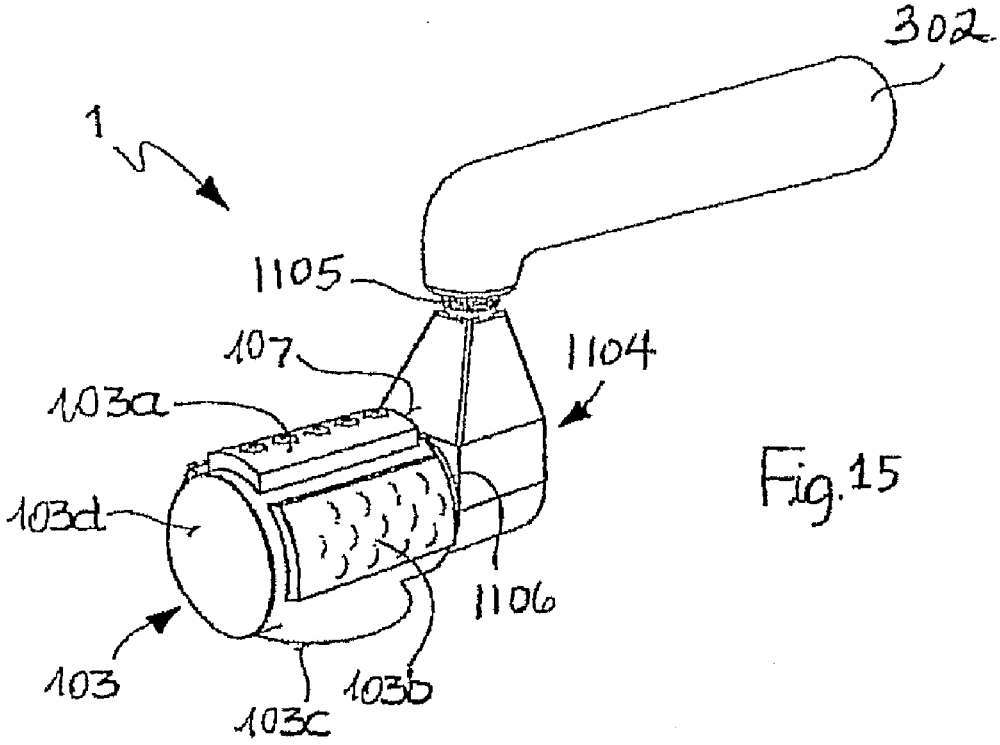
FIG. 15 is a perspective view of the multiple configuration shower device according to the invention, of the wall-mounted shower head type in a seventh embodiment.

With particular reference to FIG. 15, the reference numeral 1 generally designates a multiple configuration shower device according to the invention in a seventh embodiment, this time of the wall-mounted head type. The device of the wall-mounted head type is absolutely versatile in use and adapted for any type of shower enclosure without any limitation.

The device of the wall-mounted shower head type comprises, in a traditional manner, at least one terminal portion for connection to the water mains of the shower enclosure, which is substantially tubular and is designated by the reference numeral 302, and at least one water dispensing head, generally designated by the reference numeral 103. According to the invention, the dispensing head 103 is provided advantageously with a plurality of water ejection faces 103*a*, 103*b*, 103*c*, 103*d*, each provided with respective nozzles in any number, shape and distribution; the device of the wall-mounted shower head type further comprises at least one connector, which is generally designated by the reference numeral 104 and is provided between the terminal connecting portion 302 and the head element 103 and is adapted to allow the manual rotation of the head element 103 about at least one axis so as to arrange selectively at least one of the ejection faces 103*a*, 103*b*, 103*c*, 103*d* substantially downward so as to spray the user.

In greater detail, the head element 103 comprises at least one internal chamber, which is connected to the connector 1104 and is affected by at least one water outflow port, and at least one external drum which can rotate selectively and hermetically in a plurality of positions, so as to arrange each of the ejection faces 103*a*, 103*b*, 103*c*, 103*d* at, and with a hydraulic connection to, the outflow port of said chamber.

Conveniently, the connector 1104 is substantially L-shaped and has a first end 1105 for hermetic connection to the terminal connecting portion 302 and a second end 1106 for rotary hermetic connection to the head 103; of course, the connector 1104 forms internally at least one channel, not shown in the figures for the sake of simplicity, which is adapted to provide a hydraulic connection between the first end 1105 and the second end 1106.

It is specified that the connection between the first end 1105 of the connector 1104 and the terminal connecting portion 302 is provided by means of traditional hydraulic technologies with suitable static gaskets; the connection between the second end 1106 and the head element 103 is instead provided by means of a sealing gasket for rotary parts, of a known and commercially available type. As can be seen in FIG. 15, the head 103 has a cylindrical shape, which is rendered substantially coaxial to the second end 106 of the connector at a base 107 and is provided, along the lateral surface 108, with a plurality (in the specific case, four) of the ejection faces 103*a*, 103*b*, 103*c*, 103*d*, which are mutually substantially angularly equidistant; however, the number of ejection faces can be any in relation to the specific requirements of application.

Figure 16:
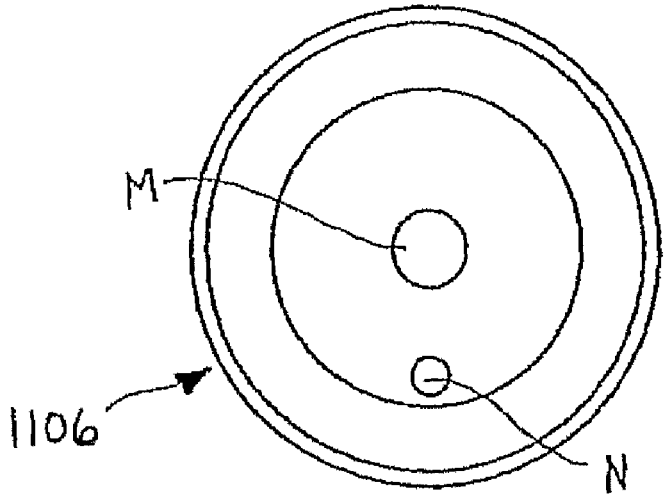
FIGS. 16 and 17 are detail views of the connection between the terminal connecting portion and the head element.
Figure 17:
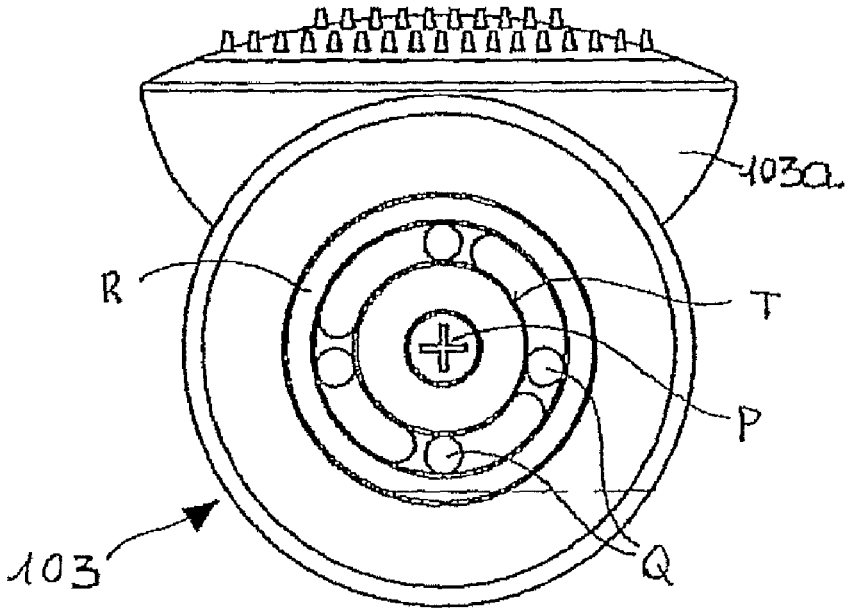

All the components can be made for example of metallic material or equally of plastic material or any other suitable material. FIGS. 16 and 17 illustrate a possible but not exclusive embodiment of the connection between the second end 1106 of the connector 1104 and the head element 103. In particular, said figures show respectively the two faces of said connection.

FIG. 16 is a front view of the second end 1106 of the connector 1104, which forms a central hole M for a mechanical mating and a port N for water outflow, which is arranged eccentrically. FIG. 17 instead is again a front view of the cylindrical head element 103. The head element 103 comprises, in greater detail, a central pivot P, which is adapted to engage in the central hole M, and further has a distribution of water inflow openings Q (four in the example shown), each connected respectively to the ejection faces 103*a*, 103*b*, 103*c*, 103*d*. The openings Q are arranged substantially along a circumference which is concentric to the pivot P and are mutually angularly equidistant. A flat gasket R with four circumferential slots T is mounted around them.

The method of use of the wall-mounted shower head according to the invention is as follows. It is sufficient to turn manually the head element 103 in one direction or the other to obtain different jets of water in relation to the different characteristics of each of the ejection faces. In particular, by turning the head element 103 about the central pivot P, the port N is connected selectively to one or the other of the openings Q, so as to convey water to one or the other of the ejection faces 103*a*, 103*b*, 103*c*, 103*d*; optimum tightness is ensured by the flat gasket R.

Figure 18:
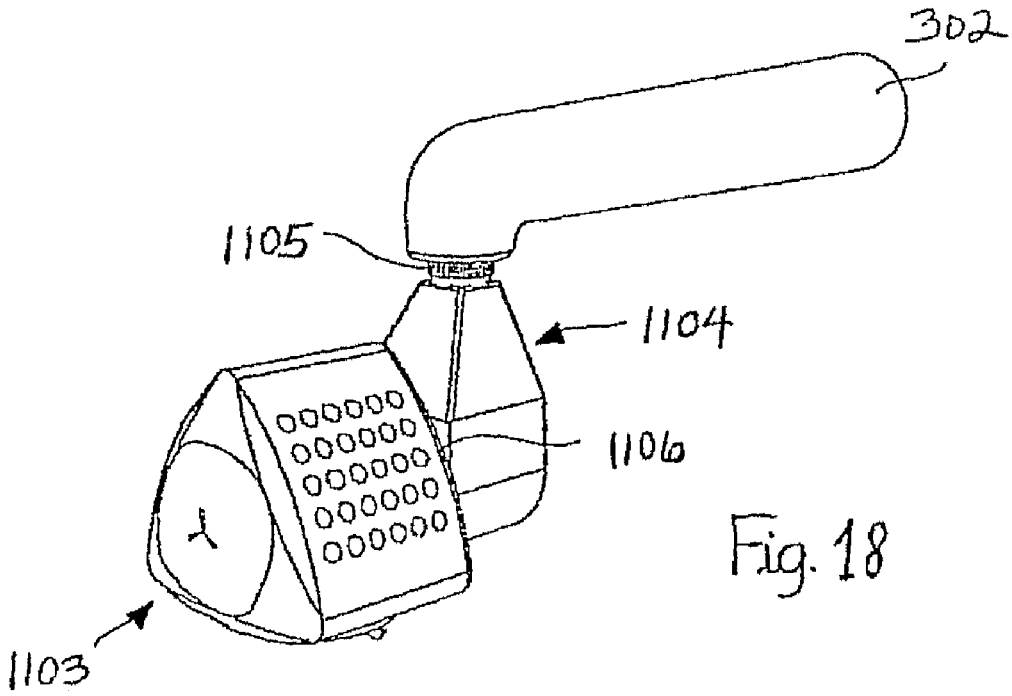
FIG. 18 is a perspective view of the device of the wall-mounted shower head type in an eighth embodiment.

FIG. 18 is a view of an eighth embodiment of the wall-mounted shower head device according to the invention. The head element 1103 here has a substantially polyhedral shape, is connected to the second end 1106 of the connector 1104 at a base 107 thereof, and has lateral surfaces which form the water ejection faces 103*a*, 103*b*, 103*c*. In the illustrated embodiment, the head element 103 in particular has three ejection faces, and their number can in any case be any.

Figure 19:
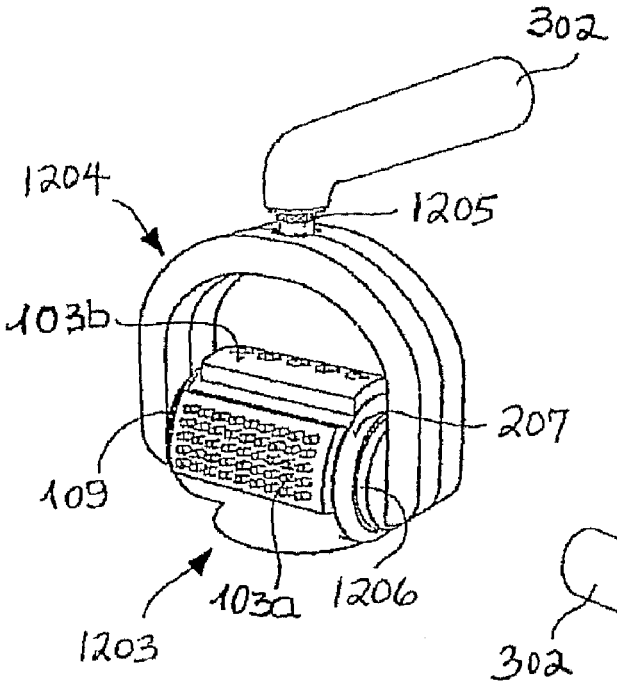
FIG. 19 is a perspective view of the device of the wall-mounted shower head type in a ninth embodiment.

A ninth embodiment is shown in FIG. 19. The connector 1204 here is substantially fork-shaped and comprises a first end 1205 for hermetic connection to the end portion 302 for connection, a second end 1206 and a third end 109 for rotary hermetic connection to mutually opposite surfaces of the head element 1203. The connector forms in its interior, which is not shown for the sake of simplicity, at least one channel for connecting the first end 1205 to the second end 1206 and to the third end 109, which is fork-shaped. The head element 1203 of the example of FIG. 19 is substantially cylindrical, the mutually opposite surfaces for connection to the connector 1204 being provided at the end faces 207 and provided along the lateral surface with a plurality of ejection faces 103*a*, 103*b*, 103*c*, 103*d* which are mutually substantially angularly equidistant.

Figure 20:
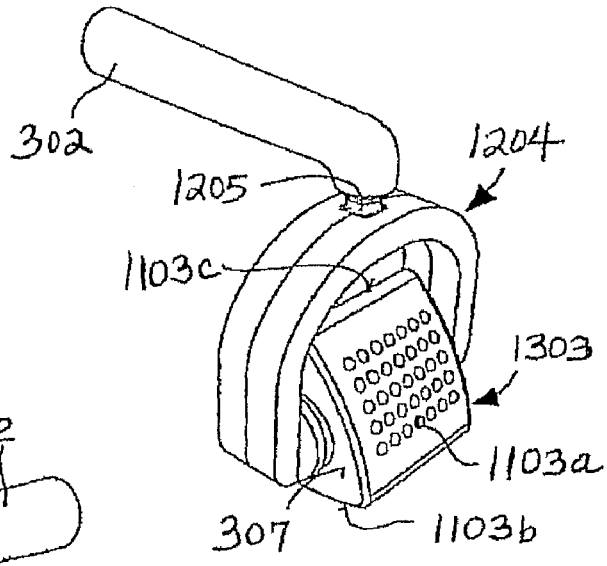
FIG. 20 is a perspective view of a device of the wall-mounted shower head type in a tenth embodiment.

A tenth embodiment is shown in FIG. 20. The head 1303 here has a substantially polyhedral shape, with mutually opposite surfaces for connection to the connector 1204 provided at the end faces, and has lateral surfaces which form the water ejection faces 1103*a*, 1103*b*, 1103*c*.

Figure 21:
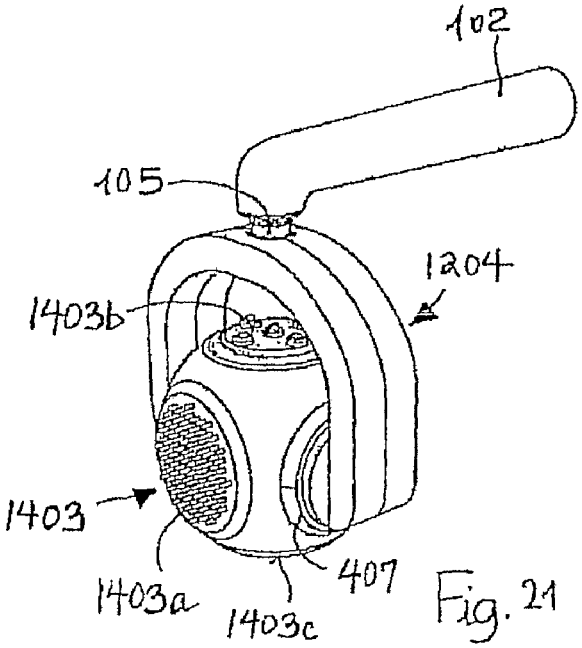
FIG. 21 is a perspective view of a device of the wall-mounted shower head type in an eleventh embodiment according to the invention.

An eleventh embodiment is shown in FIG. 21. The head element 1403 is substantially spherical and forms an axis of rotation which defines the mutually opposite connecting surfaces 407: the ejection faces 1403*a*, 1403*b*, 1403*c*, 1403*d*, which are mutually substantially angularly equidistant, are provided around the rotation axis on the remaining portion of the surface of the head element 1403.

It has thus been shown that the invention achieves the intended aim and objects. The invention thus conceived is susceptible of numerous modifications and variations, all of which are within the scope of the appended claims. All the details may further be replaced with other technically equivalent ones. In practice, the materials used, as well as the shapes and dimensions, may be any according to requirements without thereby abandoning the scope of the protection of the appended claims. The disclosures in Italian Patent Applications No. B02006A000219 and No. B02006A000220, from which this application claims priority, are incorporated herein by reference.

The invention claimed is:

1. A multiple configuration shower device, comprising at least one handle which is connected to a flexible duct for supplying water and at least one water dispensing element, wherein said dispensing element is provided with a plurality of water ejection faces, each provided with respective nozzles (U), and comprising at least one connector, provided between said handle and said dispensing element, which is adapted to allow manual rotation of said dispensing element about at least one axis which is substantially perpendicular to said handle, so as to arrange selectively at least one of said ejection faces substantially in a direction of a user, wherein said connector comprises a central hole for mechanical coupling and a port for the outflow of water which is arranged eccentrically, said dispensing element comprising a central pivot which is adapted to engage in said central hole and further having a distribution of water inflow openings, which are arranged substantially along a circumference which is concentric to said pivot, each adapted to be connected selectively, by manual rotation of said dispensing element, respectively to said ejection faces, at least one flat sealing gasket, with circumferential slots which surround said openings, being provided and rigidly coupled to said dispensing element.

2. The shower device according to claim 1, wherein at least one of said ejection faces comprises a plurality of balls and/or peduncles, which are adapted to apply a massaging action to the body of the user by direct contact on the skin.

3. The shower device according to claim 1 wherein said connector is substantially fork-shaped and comprises a first end and a second end for hermetic rotary connection to mutually opposite end faces of said dispensing element, said connector forming internally at least one channel for the connection of a threaded shank of said handle with said first and second ends.

4. The shower device according to claim 1 wherein said dispensing element is substantially cylindrical and has, along its lateral surface, a plurality of said ejection faces, which are mutually substantially angularly equidistant.

5. The shower device according to claim 1 wherein said dispensing element is substantially polyhedral and has lateral surfaces which form said water ejection faces.

6. The shower device according to claim 1 wherein said dispensing element is substantially spherical and forms an axis of rotation which defines at least one end face for connection to said connector, said ejection faces being provided around said axis on the remaining portion of the surface of said dispensing element and being substantially mutually angularly equidistant.

7. The shower device according to claim 1 wherein said dispensing element is substantially lens-shaped, with two mutually opposite ejection faces, which are connected to said connector in two diametrically opposite points.

8. A multiple configuration shower device, comprising at least one terminal portion for connection to a water mains of a shower enclosure and at least one water dispensing head element, wherein said head element is provided with a plurality of ejection faces for ejecting the water, each provided with respective nozzles, and comprises at least one connector, which is provided between said terminal connecting portion and said head element and adapted to allow a manual rotation of said head element about at least one axis so as to arrange selectively at least one of said ejection faces substantially downward so as to spray a user, wherein said connector has a first end for hermetic connection to said terminal connecting portion, a second end for rotary hermetic connection to said head element, and forms internally at least one channel for connecting said first end to said second end, wherein a shape of the first end of the connector relative to the second end of the connector is substantially L-shaped.

9. The device according to claim 8, wherein said second end of said connector forms a central hole for mechanical mating and a port for the outflow of water which is arranged eccentrically, said head element comprising a central pivot which is adapted to engage in said central hole, and further having a distribution of water inflow openings, which are arranged substantially along a circumference which is concentric to said pivot, each adapted to be arranged selectively in connection, by manual rotation of said head element, respectively to said ejection faces, at least one flat sealing gasket, with circumferential slots which surround said openings, being provided and rigidly coupled to said head element.

10. The shower device according to claim 8, wherein said head element is substantially cylindrical and coaxial to said second end of said connector at an end face and is provided, along its lateral surface, with a plurality of said ejection faces, which are mutually substantially angularly equidistant.

11. The shower device according to claim 8, wherein said head element is substantially polyhedral, is connected to a second end of said connector at an end face thereof, and has lateral surfaces which form said water ejection faces.

12. The shower device according claim 8, wherein said connector is substantially fork-shaped and comprises a first end for hermetic connection to said terminal connecting portion, a second end and a third end for a hermetic rotary connection to mutually opposite surfaces of said head element, said connector forming internally at least one channel for connection of said first end with said second and third ends.

13. The shower device according to claim 12, wherein said head element is substantially cylindrical, with said mutually opposite surfaces for connection to said connector which are provided at end faces, and is provided, along its lateral surface, with a plurality of said ejection faces, which are mutually substantially angularly equidistant.

14. The shower device according to claim 12, wherein said head element is substantially polyhedral, with said mutually opposite surfaces for connection to said connector provided at end faces, and having lateral surfaces which form said water ejection faces.

15. The shower device according to claim 12, wherein said head element is substantially spherical and forms an axis of rotation which defines said mutually opposite connecting surfaces, said ejection faces being provided around said axis on the remaining portion of the surface of said head element and being substantially mutually angularly equidistant.

16. A multiple configuration shower device, comprising at least one handle which is connected to a flexible duct for supplying water and at least one water dispensing element, wherein said dispensing element is provided with a plurality of water ejection faces, each provided with respective nozzles, and comprising at least one connector, provided between said handle and said dispensing element, which is adapted to allow manual rotation of said dispensing element about at least one axis which is substantially perpendicular to said handle, so as to arrange selectively at least one of said ejection faces substantially in a direction of a user, wherein said connector is substantially fork-shaped and comprises a first end and a second end for hermetic rotary connection to mutually opposite end faces of said dispensing element, said connector forming internally at least one channel for the connection of a threaded shank of said handle with said first and second ends.

* * * * *